United States Patent [19]

Goto et al.

[11] Patent Number: 4,653,898

[45] Date of Patent: Mar. 31, 1987

[54] SCAN TYPE ANAMORPHIC MAGNIFYING APPARATUS

[75] Inventors: Yasuo Goto, Nagoya; Yoshihiro Hanada, Toyokawa, both of Japan

[73] Assignee: Minolta Camera Kabushiki Kaisha, Osaka, Japan

[21] Appl. No.: 811,347

[22] Filed: Dec. 20, 1985

[30] Foreign Application Priority Data

Dec. 27, 1984 [JP] Japan ..... 59-281543

[51] Int. Cl.[4] ..... G03G 15/28; G03G 15/04

[52] U.S. Cl. ..... 355/8; 355/55

[58] Field of Search ..... 355/8, 47–49, 355/55–57

[56] References Cited

U.S. PATENT DOCUMENTS 3,445,161 5/1969 Moss ..... 355/47

4,583,846 4/1986 Nakamura et al. ..... 355/57

FOREIGN PATENT DOCUMENTS 53-28087 8/1978 Japan .

58-163933 9/1983 Japan .

*Primary Examiner*—R. L. Moses

*Attorney, Agent, or Firm*—Burns, Doane, Swecker & Mathis

[57] ABSTRACT

A scan type anamorphic magnifying apparatus provided with a scanning device for scanning an original document in form of a slit, an image forming device for projecting and forming an image of the scanned document on a photosensitive member, and a device for substantially continuously varying a moving speed of the scanning device relative to a moving speed of the photosensitive member to permit the image of the document to be formed on the photosensitive member in varied magnifications. The apparatus further comprises an anamorphic optical unit movable into and out of a projection optical path leading to the photosensitive member. This optical unit is moved out of the optical path when anamorphic magnification is in a range close to "1" and into the optical path when the magnification is in a range far from "1".

8 Claims, 10 Drawing Figures

SCAN TYPE ANAMORPHIC MAGNIFYING APPARATUS

BACKGROUND OF THE INVENTION

1. Field of the Invention

The present invention relates to a scan type anamorphic magnifying apparatus mounted in a copying machine or the like for scanning an original document and enlarging or reducing copies of the document to a selected size with different rates of change for longitudinal and transverse dimensions.

2. Description of the Prior Art

A known scan type anamorphic magnifying apparatus comprises a scanning device for causing a slit to scan an original document transversely thereof, and an image forming device for projecting and forming an image of the document on a photosensitive member moving in a direction corresponding to the direction in which the slit scans the document. The image is formed in different magnifications in the scanning direction and a direction perpendicular thereto by differentiating a speed of scanning by the scanning device and a speed of movement of the photosensitive member. With this type of apparatus, however, the image projected on the photosensitive member becomes blurred and has a reduced resolving power because the speed of scanning the document and the speed of movement of the photosensitive member are different in the direction corresponding to the scanning direction.

An apparatus has been proposed in which a cylindrical lens is fixedly provided on a projection optical path leading to the photosensitive member in order to prevent the reduction of resolving power. However, this apparatus as well as the other have the drawback of a limited magnifying power range for realizing permissible resolving power.

SUMMARY OF THE INVENTION

Having regard to the above-noted state of the art, an object of the present invention is to provide a scan type anamorphic magnifying apparatus capable of a wide magnifying power range without reducing the resolving power.

This object and other objects of the present invention are achieved by a scan type anamorphic magnifying apparatus comprising an image forming device for projecting an image of an original document scanned by a slit on a photosensitive member, and an anamorphic optical unit provided on a projection optical path leading to the photosensitive member and having a refractive power only in a direction corresponding to a scanning direction, the optical unit being movable between a position to effect a refractive action on a projected light and an inoperative position. The anamorphic optical unit is retracted from the optical path when anamorphic magnification is in a range close to "1", and is placed on the optical path when anamorphic magnification is in a range far from "1". Therefore, permissible resolving power is available over a wide magnification range embracing the above two ranges.

BRIEF DESCRIPTION OF THE DRAWINGS

The above and other objects and features of the present invention will become apparent from the following description taken in conjunction with the preferred embodiment thereof with reference to the accompanying drawings, in which.

DETAILED DESCRIPTION OF THE INVENTION

Figure 1:
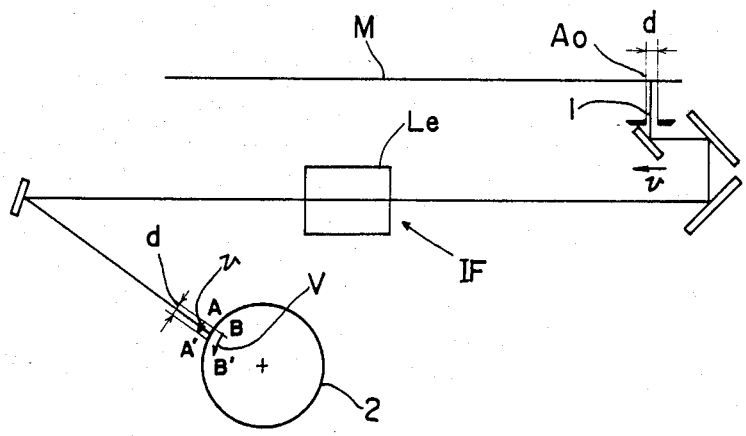
FIG. 1 is a schematic view of a scan type anamorphic magnifying apparatus which does not include an anamorphic optical unit on an optical path.

First, magnification-resolving power characteristics of the case where an anamorphic optical unit is not present on a projection optical path leading to a photosensitive member will be described with reference to FIG. 1.

Figure 2:
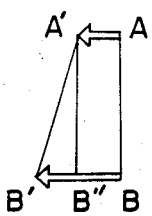
FIG. 2 is a view illustrating a slip or discord occurring with an image formed on a photosensitive member in the apparatus of FIG. 1.

An image of an original document M opposed to a slit 1 of a scanning device in a given position always is projected and formed on a given position of a photosensitive member 2 by means of an image forming device IF. With a movement of the slit 1 a point Ao on the document M moves from a point A to a point B of the slit for projection on the photosensitive member 2. At this time a corresponding point B on the photosensitive member 2 moves to a point B′ with a movement of the photosensitive member 2 which is at a different speed from the movement of the slit 1. In other words, points A and B are in overlapping positional relationship when the slit 1 reaches point Ao, but points A′ and B′ are not in overlapping relationship when the slit 1 has moved past point Ao. The positions of these points A, A′, B and B′ are as shown in FIG. 2. Assuming that the speed of the photosensitive member 2 is V, the speed of scanning the document M is v, and the slit 1 has a width d, then $$\overline{AA'}=d \tag{1}$$

$$\overline{BB'}=d\cdot V/v \tag{2}$$

$$\overline{A'B'}=\overline{B''B'}=\overline{BB'}-\overline{AA'}=\{(V-v)/v\}\cdot d \tag{3}$$

The ratio (V/v) between the scanning speed v and the speed V of the photosensitive member 2 is related to magnification in the direction of scanning. Where the magnification in a direction perpendicular to the scanning direction is "1", the ratio corresponds to a rate of anamorphic magnification itself. In other words, the farther this magnification is from "1", the greater becomes a slip or discord in the image.

Figure 3:
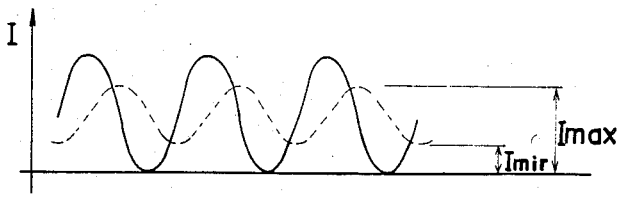
FIG. 3 is a view illustrating modulation transfer function.

Optical transfer function (hereinafter abbreviated as OTF) is known as means to indicate resolving power at times of image formation. This is derived from Fourier transformation of the intensity distribution function of a spot image, and the magnitude of OTF is modulation transfer function (MTF) and its phase term is phase transfer function PTF. MTF represents a transmission rate of contrast with respect to an input having a certain spatial frequency represented by the number of lines per unit length. If, for example, input and output contrasts are represented by a solid line and a broken line in FIG. 3, respectively, MTF is expressed by the following equation using a maximum value Imax and a minimum value Imin of the output:

$$MTF=(Imax-Imin)/(Imax+Imin) \quad (4)$$

That is to say the lower the output contrast is than the input contrast, the smaller and closer to "0" MTF becomes. Conversely, the closer the output contrast is to the input contrast, the greater and closer to "1" becomes MTF.

Figure 4A:
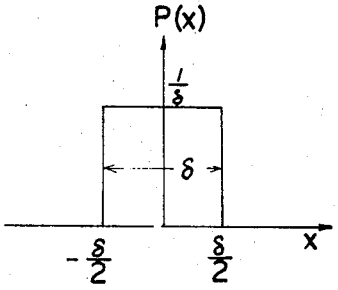
FIGS. 4*a* and 4*b* are views illustrating a reduction of resolving power owing to slips or discords in dot images on the photosensitive member.

If, for example, a certain spot is blurred because of a uniform slip or discord resulting from the difference between the scanning speed and the speed of the photosensitive member as described hereinbefore, its intensity distribution function P(x) is derived from the following equation:

$$P(x)=1/\delta;\ |x|\leqq\delta/2$$

$$P(x)=0;|x|>\delta/2 \quad (5)$$

wherein $\delta$ represents a range (mm) of the slip and a total quantity of light of the spot image is normalized to "1". This function P(x) is a rectangular function as shown in FIG. 4*a*, and OTF which is the Fourier transformation of this function is derived from the following equation:

$$OTF=\{\mathrm{Sin}\ (\pi\cdot dN)\}/\pi\cdot dN \quad (6)$$

wherein N represents a spatial frequency.

Figure 4B:
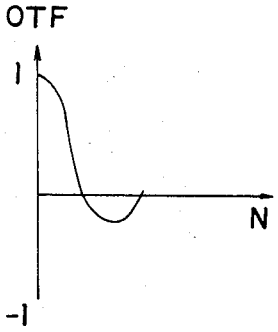

This OTF is as shown in FIG. 4*b*. In this case too, MTF is the magnitude of OTF, and the greater the spatial frequency N becomes, the lower becomes the contrast and the resolving power due to the discord or slip.

Figure 6:
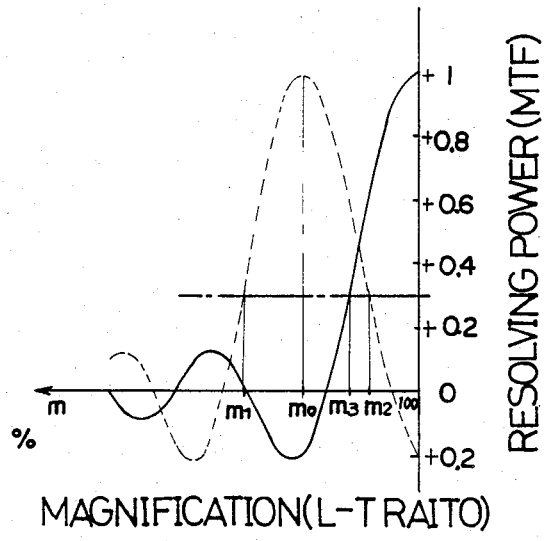
FIG. 6 is a graph showing longitudinal-transverse ratio-resolving power characteristics.

One example of MTF characteristics where the spatial frequency is 4 (line/mm) is shown by a solid line in FIG. 6. The axis of ordinate in FIG. 6 is the resolving power and the axis of abscissa is a ratio between magnification in the scanning direction and magnification in the direction perpendicular to the scanning direction, namely a longitudinal-transverse ratio indicating the anamorphic magnification, and 100% is when the two magnifications are the same. As is clear from this graph, when the magnification in the scanning direction and the magnification in the direction perpendicular to the scanning direction are equal, a slip or discord as shown in FIG. 2 does not occur and therefore the resolving power is at the highest degree, meanwhile, MTF becomes lower with decreasing the longitudinal-transverse ratio. A lower limit of this MTF for practical purposes is determined by varied factors. If, for example, the lower limit is 0.3, the range of variations in the longitudinal-transverse ratio is from $m_3$ to 100.

Figure 5:
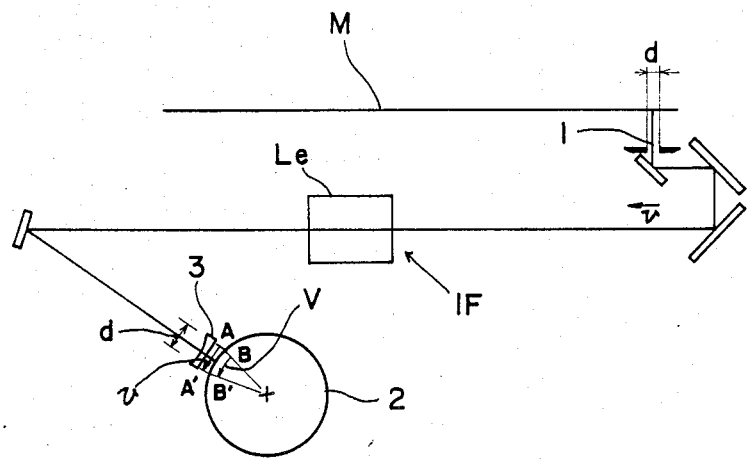
FIG. 5 is a schematic view of a scan type anamorphic magnifying apparatus comprising an anamorphic optical unit on an optical path.

Next, magnification-resolving power characteristics in the case where an anamorphic optical unit 3 having the magnification V/v in the scanning direction is provided on the projection optical path as shown in FIG. 5, with the other conditions the same as in the preceding example, will be described.

The projecting slit has a width d as in the preceding example immediately before the anamorphic optical unit 3, and this width d is enlarged ((V/v). d) in the scanning direction by the element 3. Therefore, this equals a moving distance of the corresponding point on the photosensitive member 2 as expressed by Equation 2, which causes no discord or slips in the image and no reduction in resolving power.

As in the previous case, the MTF characteristics where the spatial frequency is 4 (line/mm) are shown by the broken line in FIG. 6. MTF is at a maximum value of "1" when the longitudinal-transverse ratio is $m_0$ corresponding to the magnifying power of the anamorphic optical unit. MTF lowers as the longitudinal-transverse ratio m deviates therefrom. In a range where MTF is below a certain value, the resolving power drops to a substantial degree and images unfit for practical purposes will be produced. Where the practicable lower limit of MTF is 0.3, the range for permitting the anamorphic magnification are in the longitudinal-transverse ratio between $m_1$ and $m_2$.

It will be understood from the foregoing description that, when the longitudinal-transverse ratio is close to 100, the resolving power is high without the anamorphic unit and, when the longitudinal-transverse ratio changes, a corresponding anamorphic unit had better be provided to obtain high resolving power. In either case, however, the range for permitting variations of the longitudinal-transverse ratio is limited.

Figure 8:
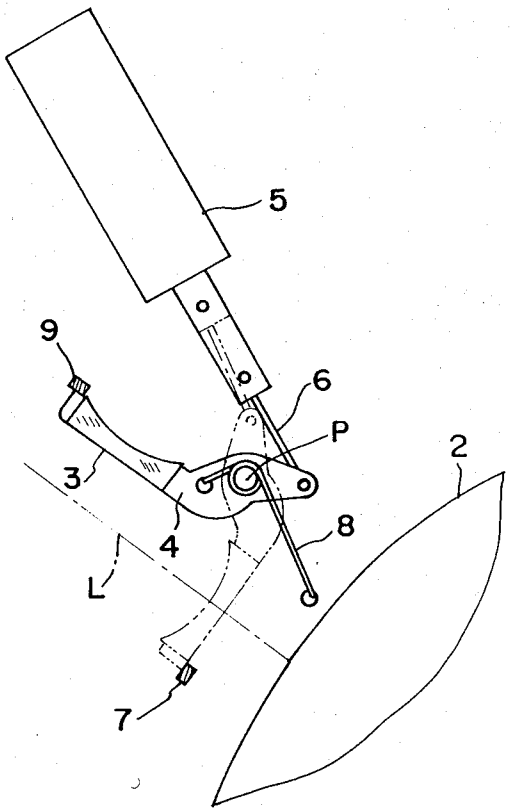
FIG. 8 is a view showing one example of device for moving the anamorphic optical unit between an operative position and an inoperative position.
Figure 7:
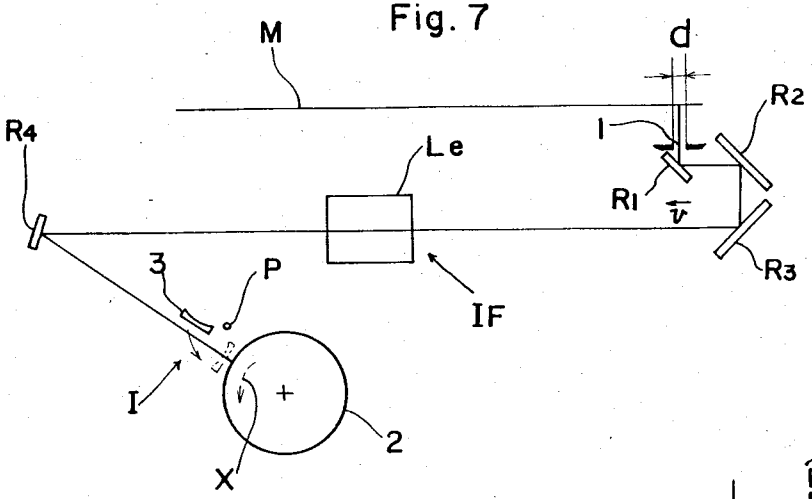
FIG. 7 is a schematic view of a scan type anamorphic magnifying apparatus according to a preferred embodiment of the present invention.

A scan type anamorphic magnifying apparatus according to a preferred embodiment of the invention will now be described in detail with reference to FIGS. 7 through 9.

The apparatus comprises a slit 1 disposed below an original document M and having a width d. The image of a portion of the document M opposed to the slit 1 is projected and formed on a photosensitive drum 2 which is one example of photosensitive member, through an image forming device IF including four mirrors R1–R4 and an image forming lens Le. The slit 1 and the first mirror R1 are movable together by a drive mechanism, not shown, in the leftward direction in the drawing. The second and third mirrors R2 and R3 are movable as same as the slit and the first mirror, but with half speed thereof. The photosensitive drum 2 is rotatable by a drive mechanism, not shown, in the x direction in the drawing. Moving speeds of the slit 1 and the first, second and third mirrors are continuously variable by a control mechanism, not shown, with respect to a rotating speed of the photosensitive drum 2, thereby forming an image on the drum 3 having a selected longitudinal-transverse ratio with respect to the original document M.

The construction for continuously varying the scanning speed may be realized by modifying the construction disclosed in U.S. Ser. No. 511,390 filed July 6, 1983 and entitled "System for Controlling the Reciprocation of a Scanning Arrangement". In the construction disclosed in this prior application, ordinary magnification is continuously varied while maintaining the anamorphic magnification ratio at "1" and the scanning speed is determined by its interrelation with the ordinary magnification. The prior construction becomes available for the purpose of the present invention by eliminating this interrelation.

The apparatus embodying the present invention further comprises a cylindrical lens 3 provided on a projection optical path leading to the photosensitive drum 2 and having a refractive power only in a direction corresponding to the scanning direction. This cylindrical lens 3 which is one example of anamorphic optical unit is mounted to be rotatable on an axis P and is, by means of a switching control mechanism, movable between and locable to a position to effect a refractive action on a light projected on the photosensitive drum 2 as shown in a broken line in the drawing and a position inoperative relative to the projected light as shown in a solid line in the drawing.

An example of mounting structure and switching control mechanism will be described with reference to FIG. 8. The cylindrical lens 3 is attached to one end of a lens holder 4 pivotable on the axis P. The other end of the lens holder 4 is connected to a rod 6 linked with a solenoid 5. When the solenoid 5 is energized, the lens holder 4 is pivoted to a position to abut against a first stopper 7 and place the lens 3 in the optical path L. When the solenoid 5 is deenergized, the lens holder 4 is pivoted by the urging force of a spring 8 to a position to abut against a second stopper 9 and retract the lens 3 from the optical path L.

Figure 9:
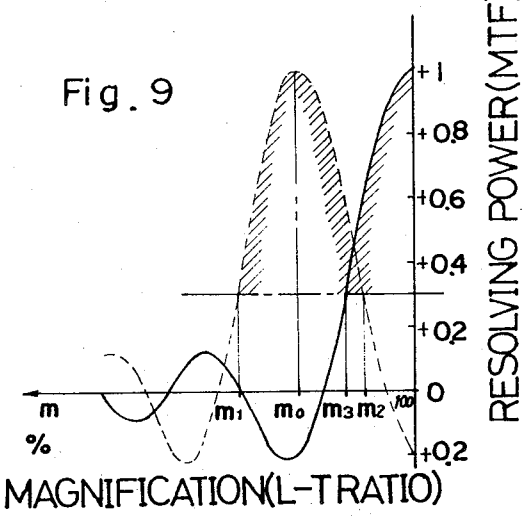
FIG. 9 is a graph showing longitudinal-transverse ratio-resolving power characteristics.

The described scan type anamorphic magnifying apparatus has resolving power characteristics with respect to the longitudinal-transverse ratio as shown in FIG. 9. The axis of abscissa is a ratio between magnification in the scanning direction and magnification in the direction perpendicular to the scanning direction, namely a longitudinal-transverse ratio indicating the an amorphic magnification, and 100% is when the two magnifications are the same. The axis of ordinate is MTF which is the magnitude of optical transfer function (MTF) indicating resolving power. MTF is "1" when a contrast at an image forming time is equal to that of an input time. The illustrated characteristics are of the case where spatial frequency represented by the number of lines per unit length is 4 (line/mm).

The solid line in FIG. 9 represents data taken when the cylindrical lens 3 is retracted from the optical path L. When the longitudinal-transverse ratio is 100%, the image on the photosensitive member 2 shows no slip and has a maximum resolving power. The resolving power lowers as the longitudinal-transverse ratio lowers. The broken line represents data taken when the cylindrical lens 3 is positioned in the optical path L. The resolving power is at its highest when the longitudinal-transverse ratio is m corresponding to the longitudinal-transverse ratio of the cylindrical lens 3 itself. The resolving power lowers as the longitudinal-transverse ratio changes upward or downward therefrom. In either case, in a range where MTF is below a certain value, copies produced are unfit for practical purposes with the resolving power too low. A practicable lower limit of the MTF is determined by varied factors. If, for example, the lower limit is 0.3, the range for longitudinal-transverse ratio variations realizing a resolving power sufficient for practical purposes is from $m_3$ to 100 when the cylindrical lens 3 is retracted from the optical path L, and is from $m_1$ to $m_2$ when the lens 3 is in the optical path L.

Therefore, the solenoid 5 is energized in order to permit the cylindrical lens 3 providing its own resolving power $m_0$ to act on the light projected on the photosensitive drum 3 in the range $m_1$–$m_2$ of the longitudinal-transverse ratio to obtain a resolving power sufficient for practical purposes. In the range $m_3$–100 of the longitudinal-transverse ratio in which the resolving power sufficient for practical purposes is obtained without the aid of the lens 3, the solenoid 5 is deenergized to keep the cylindrical lens 3 from acting on the projected light. Therefore a wide range, $m_1$–100, of longitudinal-transverse ratio variations as marked by oblique lines in FIG. 9 is secured without entailing the reduction of resolving power. It is to be noted that the solenoid 5 is deenergized in the range $m_3$–$m_2$ of longitudinal-transverse ratio.

Conversely speaking, the resolving power may be improved by providing the anamorphic optical unit 3 such as a cylindrical lens in the optical path L leading to the photosensitive drum 2, which unit 3 provides a certain longitudinal-transverse ratio of its own for a required range of longitudinal-transverse ratio. In this case the longitudinal-transverse ratio of the anamorphic optical unit preferably is in the order of two thirds of the required range of longitudinal- transverse ratio variations. A longitudinal-transverse ratio exceeding 100% is obtained by turning the original document 90 degrees, and it is therefore sufficient in substance if the upper limit of the range of longitudinal-transverse ratio variation is 100%. The maximum value of resolving power where the anamorphic optical unit 3 is not used is always provided when the longitudinal-transverse ratio is 100%. The reduction rate of resolving power is substantially the same whether the anamorphic optical unit 3 is used or not. Thus, the longitudinal-transverse ratio of the anamorphic optical unit 3 for providing a required range of longitudinal-transverse ratio variations should preferably be slightly above the midpoint of that range, namely in the order of two thirds thereof.

The anamorphic optical unit may be varied as appropriate. Instead of the cylindrical lens 3, the unit may comprise a plurality of lenses combined, for example. The position of this optical unit 3 need not necessarily be in the vicinity of the photo sensitive drum 2. The arrangement for moving the optical unit 3 into and out of the optical path L may also be varied as appropriate. The electric arrangement as in the foregoing embodiment may be replaced with a mechanical arrangement utilizing levers and the like, for example. Furthermore, the optical unit 3 may be moved by a varied mode such as by a control lever provided specially for that purpose or by an automatic operation associated with setting of the longitudinal-transverse ratio.

Although the present invention has been fully described by way of example with reference to the accompanying drawings, it is to be noted that various changes and modifications will be apparent to those skilled in the art. Therefore, unless such changes and modifications depart from the scope of the present invention, they should be construed as included therein.

What is claimed is:

1. A scan type anamorphic magnifying apparatus having a scanning device for scanning an original document in form of a slit, and an image forming device for projecting and forming an image of the scanned original document on a moving photosensitive member, a speed of scanning and a moving speed of the photosensitive member being different to form the image with different magnifications in a scanning direction and in a direction perpendicular thereto, said apparatus comprising means for substantially continuously varying a speed of the scanning device relative to the moving speed of the photosensitive member, an anamorphic optical unit having a refractive power only in a direction corresponding to the scanning direction and movable into and out of a projection optical path, and means for moving the anamorphic optical unit to a position retracted from the optical path when a ratio between magnification in the scanning direction and magnification in the direction perpendicular thereto is in a range close to "1" and to a position in the optical path when the ratio is in a range far from "1".

2. An apparatus as claimed in claim 1 wherein the anamorphic optical unit comprises a cylindrical lens.

3. A scan type anamorphic magnifying apparatus comprising:

scanning means for scanning an orginal document in form of a slit;

a movable photosensitive member;

image forming means for projecting and forming an image of the scanned original document on the photosensitive member;

means for substantially continuously varying a moving speed of the scanning means relative to a moving speed of the photosensitive member to permit the image of the original document to be formed in different magnifications in a direction of slit scanning and in a direction perpendicular thereto, said means having a range of anamorphic magnification extending from a first magnification range including one anamorphic magnification to a second magnification range adjacent the first magnification range;

an anamorphic optical unit having a refractive power only in a direction corresponding to the scanning direction and movable into and out of a projection optical path leading to the photosensitive member; and switching means for moving the anamorphic optical unit out of the optical path at times of the first magnification range and into the optical path at times of the second magnification range, thereby to establish an effective magnification range including the first and second ranges and providing a permissible resolving power.

4. An apparatus as claimed in claim 3 wherein the second magnification range substantially covers two thirds of the effective magnification range.

5. An apparatus as claimed in claim 4 wherein the first and second magnification ranges include a third range where the first and second ranges overlap each other in a permissible resolving power level.

6. An apparatus as claimed in claim 5 wherein the switching means is adapted to automatically move the anamorphic optical unit in response to setting of a magnification rate in the third range.

7. An apparatus as claimed in claim 6 wherein the switching means comprises holder means carrying the anamorphic optical unit at one end thereof and being pivotable for moving the unit into and out of the optical path, rod means attached to another end of the holder means and operable in a push-pull manner to cause the holder means to pivot for moving the unit into and out of the optical path, a first stopper for contacting the holder means to retain the unit in an operative position on the optical path, and a second stopper for contacting the holder means to retain the unit in a retracting position out of the optical path.

8. An apparatus as claimed in claim 7 further comprising spring means for urging the holder means toward the second stopper, and a solenoid for operating the rod means, the solenoid being adapted to draw the rod means, when energized, causing the holder means to pivot until the holder means contacts the first stopper, and to release the rod means, when deenergized, thereby permitting the holder means to pivot by an urging force of the spring means until the holder means contacts the second stopper.

* * * * *